US010981700B2

(12) United States Patent
Migas et al.

(10) Patent No.: US 10,981,700 B2
(45) **Date of Patent: *Apr. 20, 2021**

(54) TWIST AND FLIP LOCK CLOSURE

(71) Applicant: Closure Systems International Inc., Memphis, TN (US)

(72) Inventors: Jeremiah Migas, Crawfordsville, IN (US); Jeremy Morin, Zionsville, IN (US); Aravind Murali, West Lafayette, IN (US)

(73) Assignee: Closure Systems International Inc., Indianapolis, IN (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/863,313

(22) Filed: Apr. 30, 2020

(65) Prior Publication Data

US 2020/0283201 A1 Sep. 10, 2020

Related U.S. Application Data

(63) Continuation of application No. 16/158,475, filed on Oct. 12, 2018, now Pat. No. 10,654,625.

(51) Int. Cl.

| | |
|---|---|
| ***B65D 41/34*** | (2006.01) |
| ***B65D 1/02*** | (2006.01) |
| ***B65D 55/16*** | (2006.01) |

(52) U.S. Cl.

CPC ..... *B65D 41/3428* (2013.01); *B65D 1/0246* (2013.01); *B65D 55/16* (2013.01)

(58) Field of Classification Search

CPC ... B65D 41/3428; B65D 1/0246; B65D 55/16

(Continued)

(56) References Cited

U.S. PATENT DOCUMENTS

| | | | |
|---|---|---|---|
| 3,904,062 | A | 9/1975 | Grussen |
| 4,394,918 | A | 7/1983 | Grussen |

(Continued)

FOREIGN PATENT DOCUMENTS

| | | | |
|---|---|---|---|
| EP | 2 308 772 | A1 | 4/2011 |
| FR | 2785264 | A1 | 5/2000 |

(Continued)

OTHER PUBLICATIONS

International Search Report and Written Opinion in International Application No. PCT/US2019/055744, dated Feb. 18, 2020 (14 pages).

*Primary Examiner* — J. Gregory Pickett
*Assistant Examiner* — Niki M Eloshway
(74) *Attorney, Agent, or Firm* — Nixon Peabody LLP

(57) ABSTRACT

A twist and flip closure includes first and second closure portions. The first closure portion includes a top wall portion, a skirt portion, and first and second frangible connections. The first frangible connection extends around the closure circumference. The second frangible connection has first and second sections. The second frangible connection is spaced from the first frangible connection. At least a portion of the second frangible connection is located further from the top wall portion than a portion of the first frangible connection. The second frangible connection defines an area adapted to form a tab. The second closure portion includes a tamper-evident band. The closure is adapted to be opened by twisting to break the frangible connections and expose the tab and then flipping the first closure portion from the second closure portion via the exposed tab. The closure is adapted to be locked when flipped.

19 Claims, 8 Drawing Sheets

(58) Field of Classification Search
USPC ..... 215/44, 252, 235, 256, 258
See application file for complete search history.

(56) References Cited

U.S. PATENT DOCUMENTS

| | | | | |
|---|---|---|---|---|
| 4,805,792 | A | 2/1989 | Lecinski | |
| 5,215,204 | A | 6/1993 | Beck | |
| 5,246,125 | A | 9/1993 | Julian | |
| 5,725,115 | A | 3/1998 | Bösl | |
| 6,123,212 | A | 9/2000 | Russell | |
| 6,474,491 | B1 | 11/2002 | Benoit-Gonin | |
| 6,481,588 | B1 | 11/2002 | Wagner | |
| D593,856 | S | 6/2009 | Kubler | |
| 8,469,213 | B2 | 6/2013 | Ishii | |
| 8,485,374 | B2 | 7/2013 | Gevers | |
| 8,763,830 | B2 | 7/2014 | Sadiq | |
| 9,010,555 | B2 | 4/2015 | Luzzato | |
| 9,085,385 | B1 | 7/2015 | Costanzo | |
| 9,126,726 | B2 | 9/2015 | Edie | |
| 9,643,762 | B2 | 5/2017 | Maguire | |
| 2002/0088813 | A1 | 7/2002 | Nyman | |
| 2005/0045578 | A1* | 3/2005 | Schwarz | B65D 41/3428 215/252 |
| 2006/0163188 | A1 | 7/2006 | Lagler | |
| 2008/0011704 | A1 | 1/2008 | Van Ryn | |
| 2009/0045158 | A1 | 2/2009 | Suriol | |
| 2010/0005641 | A1 | 1/2010 | Druitt | |
| 2010/0326948 | A1 | 12/2010 | Campbell | |
| 2011/0000871 | A1 | 1/2011 | Bernard | |
| 2011/0114593 | A1 | 5/2011 | Ishii | |
| 2011/0174760 | A1* | 7/2011 | Luzzato | B65D 41/48 215/252 |
| 2011/0278299 | A1* | 11/2011 | Schueller | B65D 41/3428 220/288 |
| 2012/0024815 | A1 | 2/2012 | Kwon | |
| 2012/0285921 | A1* | 11/2012 | Kwon | B65D 55/16 215/243 |
| 2012/0298666 | A1 | 11/2012 | Kwon | |
| 2012/0305564 | A1* | 12/2012 | Hayashi | B65D 41/3428 220/288 |
| 2013/0001185 | A1* | 1/2013 | Antier | B65D 41/3442 215/252 |
| 2015/0251827 | A1 | 9/2015 | Campbell | |
| 2015/0368009 | A1* | 12/2015 | Loukov | B65D 41/485 215/43 |
| 2016/0288961 | A1 | 10/2016 | Maguire | |
| 2017/0349336 | A1 | 12/2017 | Sadiq | |
| 2018/0009979 | A1 | 1/2018 | Nishiyama | |
| 2018/0155094 | A1* | 6/2018 | Loukov | B65D 41/485 |
| 2018/0162605 | A1* | 6/2018 | Zeng | B65D 41/34 |
| 2018/0170625 | A1* | 6/2018 | Sung | B65D 55/16 |
| 2019/0185233 | A1* | 6/2019 | Wang | B65D 41/34 |

FOREIGN PATENT DOCUMENTS

| | | | |
|---|---|---|---|
| KR | 20090005746 | A | 1/2009 |
| KR | 100942642 | B1 | 2/2010 |

* cited by examiner

TWIST AND FLIP LOCK CLOSURE

CROSS REFERENCE TO RELATED APPLICATION

This application is a continuation of and claims the benefit of priority of allowed U.S. patent application Ser. No. 16/158,475 filed on Oct. 12, 2018, which is incorporated by reference in its entirety.

FIELD OF THE INVENTION

The present invention relates generally to a polymeric closure for a package. More specifically, the present invention relates to a twist and flip polymeric closure that is maintained in a locked position after opening.

BACKGROUND OF THE INVENTION

Polymeric closures have been used in many applications over the years in conjunction with containers. One type of polymeric closure that has been used with containers is a tamper-evident polymeric closure. Tamper-evident closures are used to prevent or inhibit tampering by providing a visible indication to a user if the closure has been opened. This visual indication typically divides the closure into two separate components after the tamper-evident feature has been broken. The top portion of the closure is then removed from the container to gain access to the contents of the containers. One drawback of tamper-evident closures being separated into two individual components is that the top portion may not be recycled along with the remainder of the closure and container. This scenario raises potential environmental concerns with so many containers having tamper-evident features on its closures that can be separated into two individual components.

It would be desirable to provide a flip closure that has tamper-evident features that address these above-noted environmental concerns, while still performing desirable properties of a closure including securely positioning the lid when drinking from the container.

SUMMARY

According to one embodiment, a twist and flip closure comprises a first closure portion and a second closure portion. The first closure portion includes a polymeric top wall portion, a polymeric annular skirt portion depending from the polymeric top wall portion, and first and second frangible connections. The annular skirt portion includes an internal thread formation for mating engagement with an external thread formation of a container. The first frangible connection extends around the circumference of the closure. The first frangible connection has a first end and a second end. The first end and the second end are spaced apart. The second frangible connection has a first section and a second section. The first section is located a first distance from the top wall portion. The second section is located a second distance from the top wall portion. The second distance is greater than the first distance. The second frangible connection is spaced from the first frangible connection. At least a portion of the second frangible connection is located further from the top wall portion than a portion of the first frangible connection. The first and second sections of the second frangible connection define an area that is adapted to form a tab. The area adapted to form the tab is between the first and second ends of the first frangible connection in an unopened position. The second closure portion includes a polymeric tamper-evident band depending from and being partially detachably connected to the polymeric annular skirt portion by the first frangible connection. The closure is adapted to be opened by twisting so as to break the first and second frangible connections and expose the tab, and then flipping the first closure portion from the second closure portion via the exposed tab. The closure is adapted to be locked via the tab during the flipping of the first closure portion from the second closure portion.

According to another embodiment, a twist and flip closure includes a first closure portion and a second closure portion. The first closure portion includes a polymeric top wall portion, a polymeric annular skirt portion, a first frangible connection and a second frangible connection. The polymeric annular skirt portion depends from the polymeric top wall portion. The annular skirt portion includes an internal thread formation for mating engagement with an external thread formation of a container. The first frangible connection extends around the circumference of the closure. The first frangible connection has a first end and a second end. The first end and the second end are spaced apart. The second frangible connection has a first section and a second section. The first section is located a first distance from the top wall portion. The second section is located a second distance from the top wall portion. The second distance is greater than the first distance. The second frangible connection is spaced from the first frangible connection. At least a portion of the second frangible connection is located further from the top wall portion than a portion of the first frangible connection. The first and second sections of the second frangible connection define an area that is adapted to form a tab. The area adapted to form the tab is between the first and second ends of the first frangible connection in an unopened position. An area between the first frangible connection and the second frangible connection forms hinged areas to assist in moving and locking the tab.

The second closure portion includes a polymeric tamper-evident band depending from and being partially detachably connected to the polymeric annular skirt portion by the first frangible connection. The polymeric tamper-evident including at least one band extension, the at least one band extension assisting in positioning the first closure portion in a locked position after flipping. The closure is adapted to be opened by twisting so as to break the first and second frangible connections and expose the tab and then flipping the first closure portion from the second closure portion via the exposed tab. The closure is adapted to be locked via the tab during the flipping of the first closure portion from the second closure portion.

According to a further embodiment, a package includes a container and twist and flip closure. The container has a neck portion defining an opening. The container has an external thread formation on the neck portion. The twist and flip closure is configured for fitment to the neck portion of the container for closing the opening. The twist and flip closure comprises a first closure portion and a second closure portion. The first closure portion includes a polymeric top wall portion, a polymeric annular skirt portion, a first frangible connection and a second frangible connection. The polymeric annular skirt portion depends from the polymeric top wall portion. The annular skirt portion includes an internal thread formation for mating engagement with an external thread formation of the container. The first frangible connection extends around the circumference of the closure. The first frangible connection has a first end and a second end. The first end and the second end are spaced apart. The second frangible connection has a first section and a second section. The first section is located a first distance from the top wall portion. The second section is located a second distance from the top wall portion. The second distance is greater than the first distance. The second frangible connection is spaced from the first frangible connection. At least a portion of the second frangible connection is located further from the top wall portion than a portion of the first frangible connection. The first and second sections of the second frangible connection define an area that is adapted to form a tab. The area adapted to form the tab is between the first and second ends of the first frangible connection in an unopened position.

The second closure portion includes a polymeric tamper-evident band depending from and being partially detachably connected to the polymeric annular skirt portion by the first frangible connection. The closure is adapted to be opened by twisting so as to break the first and second frangible connections and expose the tab and then flipping the first closure portion from the second closure portion via the exposed tab. The closure is adapted to be locked via the tab during the flipping of the first closure portion from the second closure portion.

The above summary is not intended to represent each embodiment or every aspect of the present invention. Additional features and benefits of the present invention are apparent from the detailed description and figures set forth below.

BRIEF DESCRIPTION OF THE DRAWINGS

Other advantages of the invention will become apparent upon reading the following detailed description and upon reference to the drawings in which.

Figure 1A:
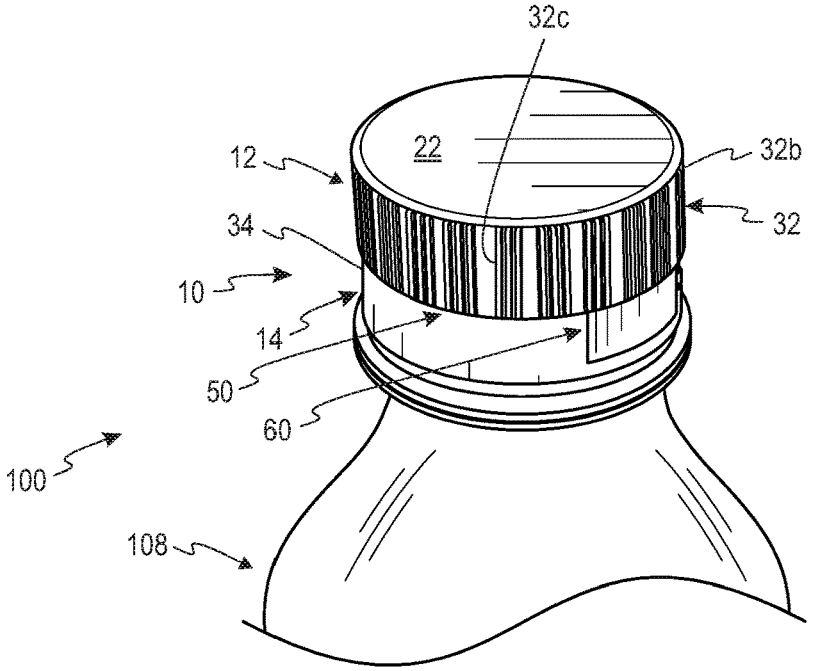
FIG. 1A is a top perspective view of a closure in an unopened position on a container according to one embodiment.

While the invention is susceptible to various modifications and alternative forms, specific embodiments thereof have been shown by way of example in the drawings and will herein be described in detail. It should be understood, however, that it is not intended to limit the invention to the particular forms disclosed, but on the contrary, the intention is to cover all modifications, equivalents, and alternatives falling within the spirit and scope of the invention as defined by the appended claims.

DETAILED DESCRIPTION

FIGS. 1A-D illustrate a package 100 including a polymeric twist and flip closure 10 and a container 108 according to one embodiment of the present invention. The twist and flip closures of the present invention are configured to be placed on a container or bottle that contain product. The product is typically a liquid product, but also may be a solid product or a combination of a liquid and solid product. The polymeric twist and flip closure 10 of FIGS. 1A-D is generally cylindrically shaped. The twist and flip closure is configured to remain with the container so as to reduce environmental waste, while still providing desirable tamper-evident features. The twist and flip closure is configured to lock after opening so as to enjoy an uninhibited drinking experience.

The polymeric twist and flip closure 10 includes a first closure portion or lid 12 and a second closure portion or base 14. The twist and flip closure 10 is a one-piece closure. The first closure portion 12 and the second close portion 14 are adapted to be twisted and then flipped with respect to each other via a tab as will be discussed in detail below. It is contemplated that the twist and flip closure may be a two-piece closure in another embodiment.

The first closure portion 12 includes a polymeric top wall portion 22 and a polymeric annular skirt portion 32. The second closure portion 14 includes a polymeric tamper-evident band 34. The polymeric tamper-evident band 34 depends from and is partially detachably connected to the polymeric annular skirt portion 32 by a first frangible connection 50 (FIG. 1A).

Figure 3:
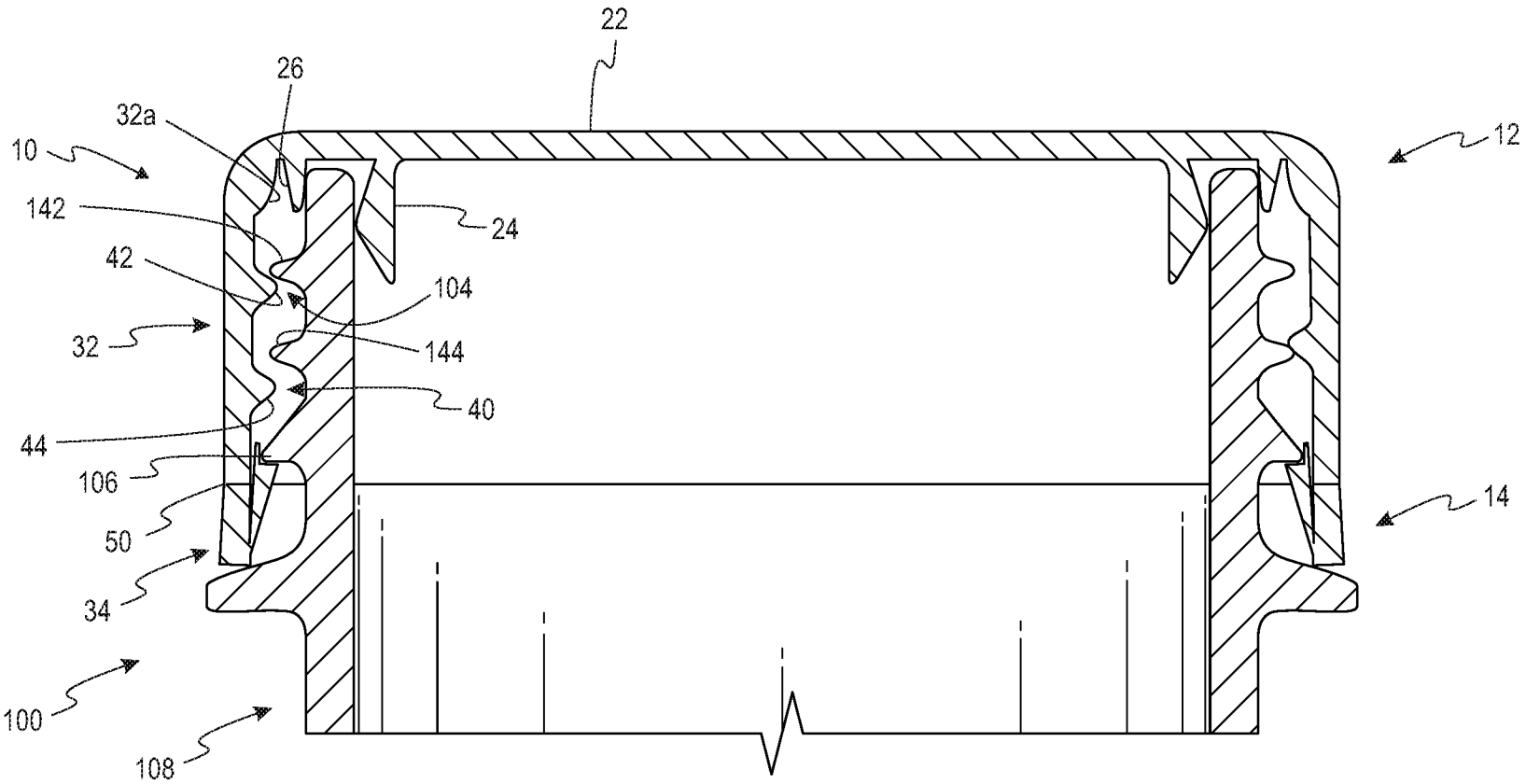
FIG. 3 is a cross-sectional view taken of the closure and the container of FIG. 1A when the closure is in an unopened position.

Referring to FIG. 3, a cross-sectional view of the package 100 is shown. The first closure portion 12 further includes a polymeric continuous plug seal 24 and an outer seal 26. A shown in FIG. 3, the polymeric continuous plug seal 24 and the outer seal 26 depend from the polymeric top wall portion 22 and provide a sealing mechanism. The continuous plug seal 24 of FIG. 3 is spaced from an interior surface 32*a* of the polymeric annular skirt portion 32. The outer seal 26 provides an outer seal with respect to an outer finish surface of the container 108.

In another embodiment, the twist and flip closure may include other sealing mechanisms. For example, the closure may include a polymeric lining material that provides a seal to the closure. In this embodiment, the closure would be formed from separate components, but would function as the closure except with a different sealing mechanism. In another embodiment, the closure may include only a polymeric outer seal or a continuous plug seal. It is contemplated that the twist and flip closure may include other sealing mechanisms.

Referring still to FIG. 3, the polymeric annular skirt portion 32 includes an internal thread formation 40 for mating engagement with an external thread formation of a container. The internal thread formation 40 includes a first closure lead 42 and a second closure lead 44. The first and second closure leads 42, 44 are referred collectively as a double lead closure thread. Each of the first and second closure leads 42, 44 is continuous. The first positions of the first and second closure leads 42, 44 may be located roughly 180 degrees apart from each other and, thus, begin on generally opposing sides of the closure 10.

It is contemplated that the first and second closure leads may be discontinuous. It is also contemplated that the internal thread formation of the closure may differ from a helical thread formation. It is also contemplated that other internal thread formations may be used in the closure. For example, the internal thread formation may include a triple-threaded structure having first, second and third closure leads.

Referring back to FIGS. 1A-D, an outer surface 32*b* of the polymeric annular skirt portion 32 may also include a plurality of ridges 32*c* thereon. The plurality of ridges 32*c* assists a user in gripping when moving the twist and flip closure 10 between closed and open positions.

Figure 1B:
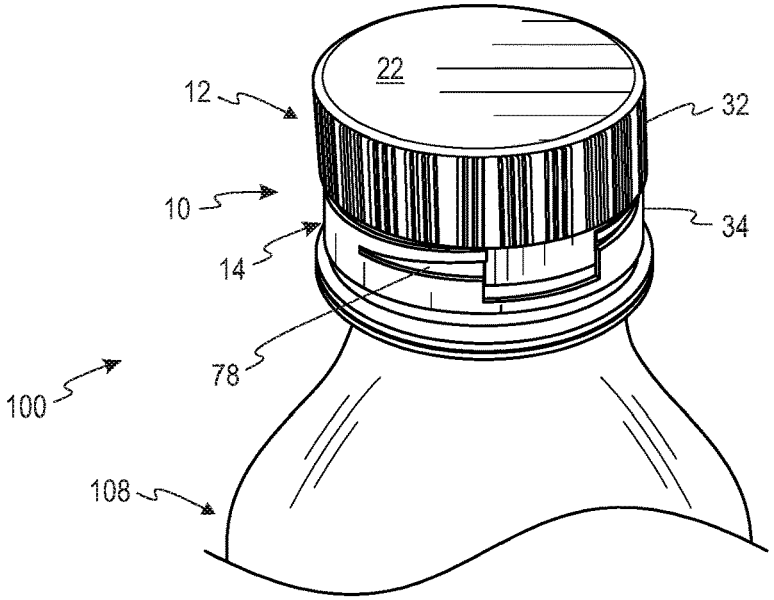
FIG. 1B is a top perspective view of the closure on the container of FIG. 1A after the closure has been partially twisted with respect to the container.
Figure 1C:
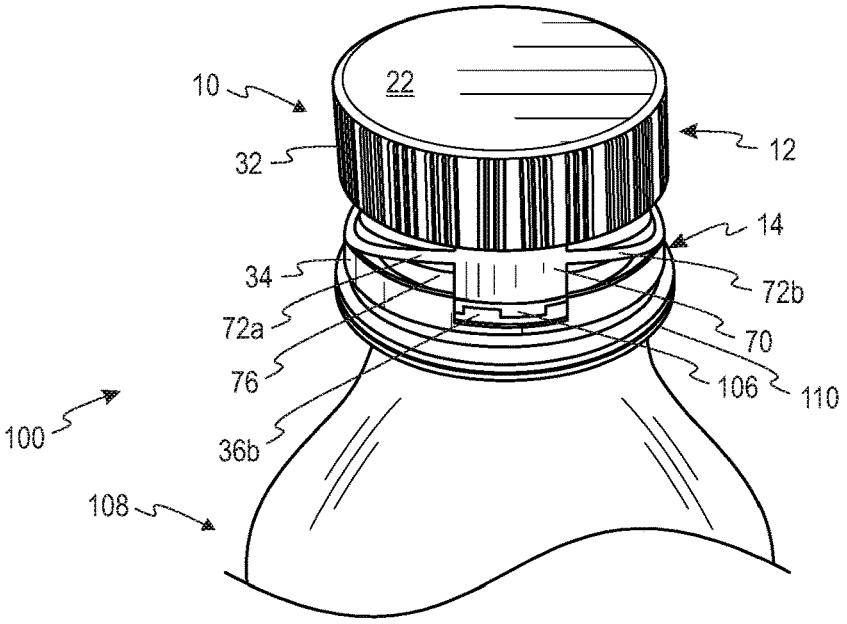
FIG. 1C is a top perspective view of the closure on the container of FIG. 1A after the closure has been fully twisted with respect to the container.
Figure 1D:
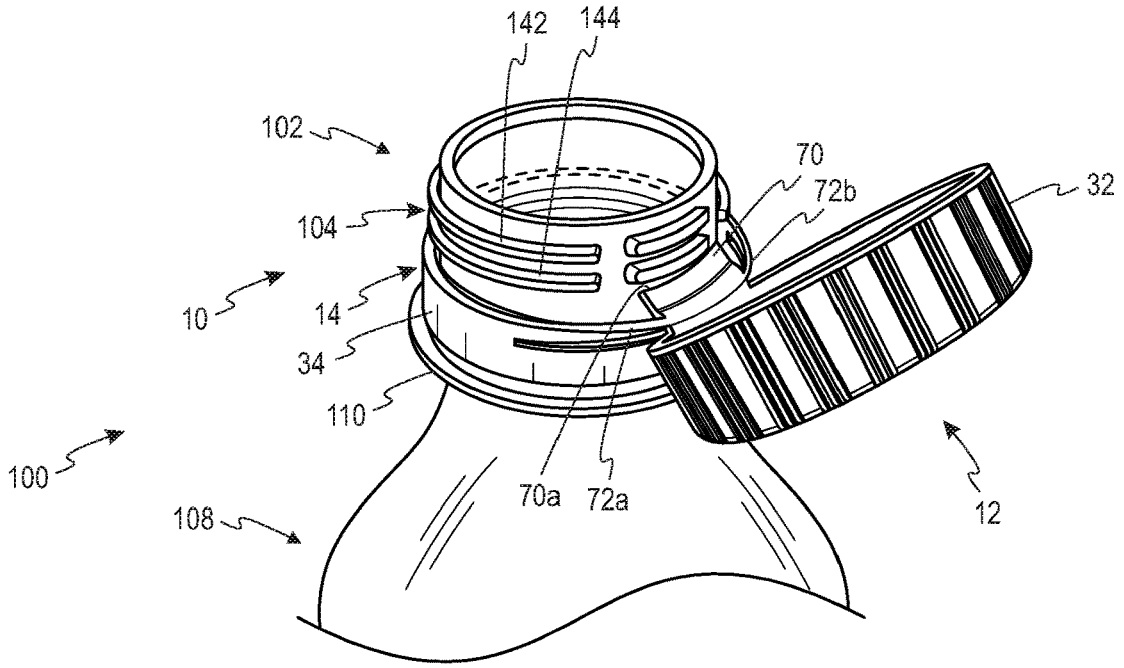
FIG. 1D is a top perspective view of the closure on the container of FIG. 1A after a lid of the container has been flipped.

The twist and flip closure 10 of FIG. 1A include the first frangible connection 50 and the second frangible connection 60. FIG. 1A depicts the closure 10 and the container 108 in an unopened position. FIG. 1B depicts the closure 10 and the container 108 in a partially open position. FIG. 1C depicts the closure 10 and the container 108 in an open, but not flipped, position. FIG. 1D depicts the closure 10 and the container 108 in the flipped and locked position. It is noted that FIG. 1C is a top perspective view of the front, while FIGS. 1A, B and D are slightly offset as compared to the view of FIG. 1C.

Figure 2A:
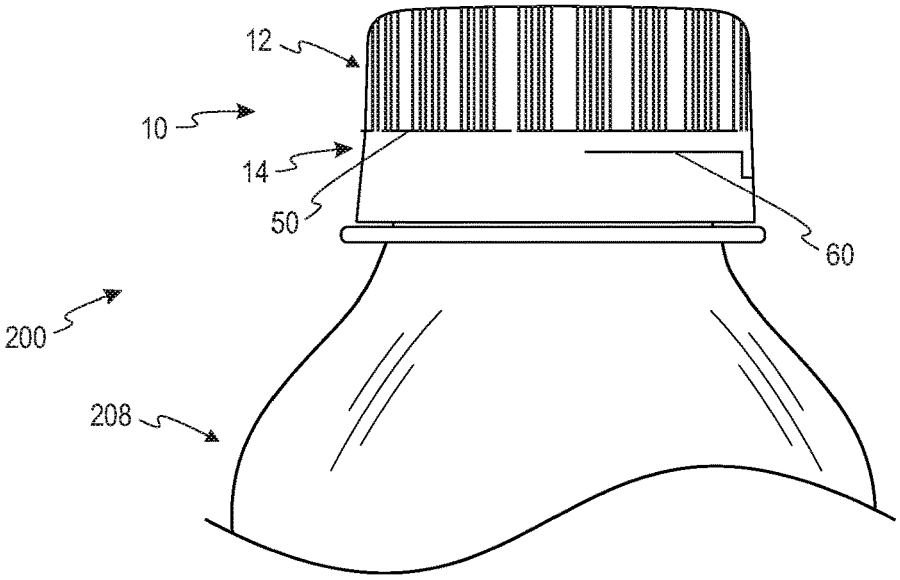
FIG. 2A is a side view of the closure of FIG. 1A in an unopened position on a container according to another embodiment.
Figure 2B:
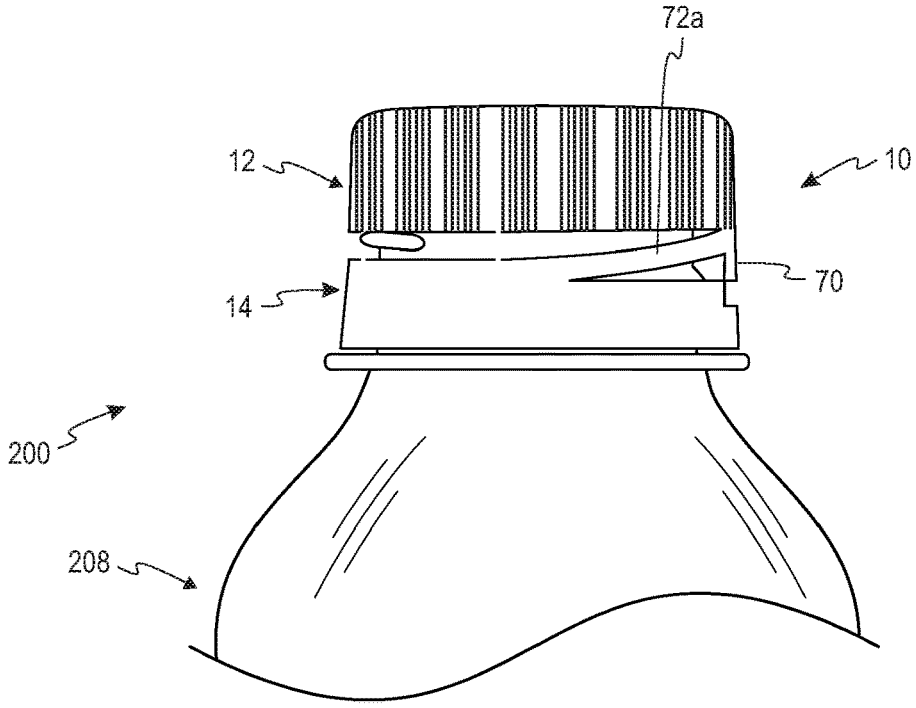
FIG. 2B is a side view of the closure on the container of FIG. 2A after the closure has been fully twisted with respect to the container.
Figure 2C:
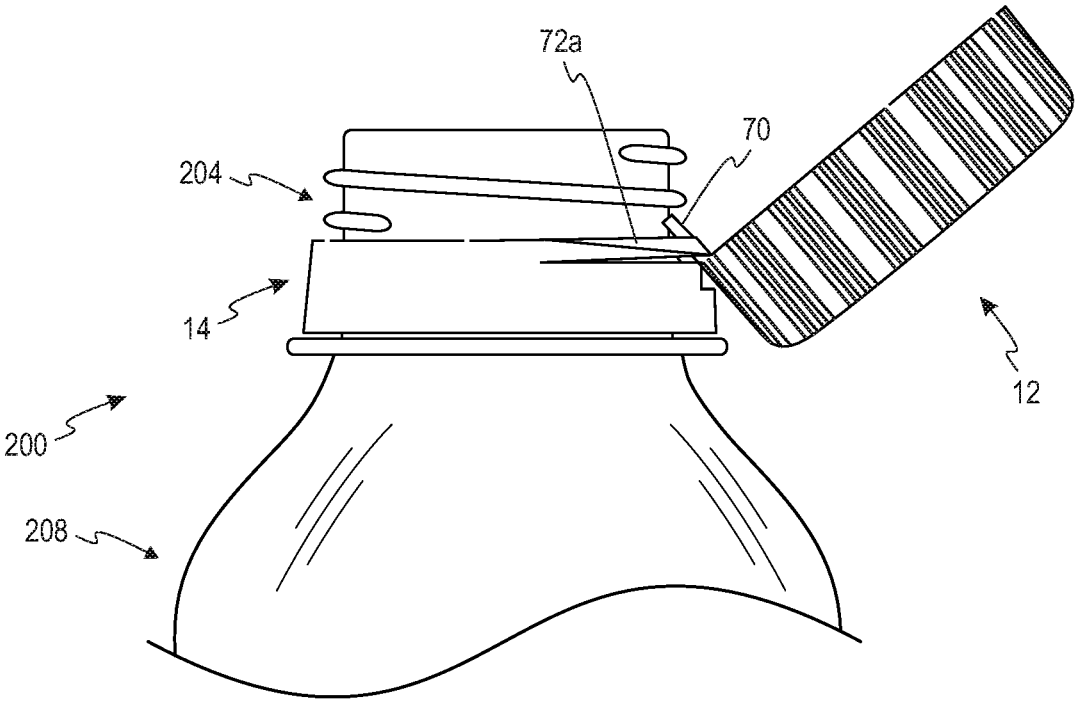
FIG. 2C is a side view of the closure on the container of FIG. 2A after a lid of the container has been flipped.

Referring to FIGS. 2A-2C, the twist and flip closure 10 is shown with a container 208 from a side perspective view that forms a package 200. The twist and flip closure 10 of FIG. 2A includes the first and second frangible connections 50 and 60. FIG. 2A depicts the closure 10 and the container 208 in an unopened position. FIG. 2B depicts the closure 10 and the container 208 in an open, but not flipped, position. FIG. 2C depicts the closure 10 and the container 208 in the flipped and locked position.

Figure 4:
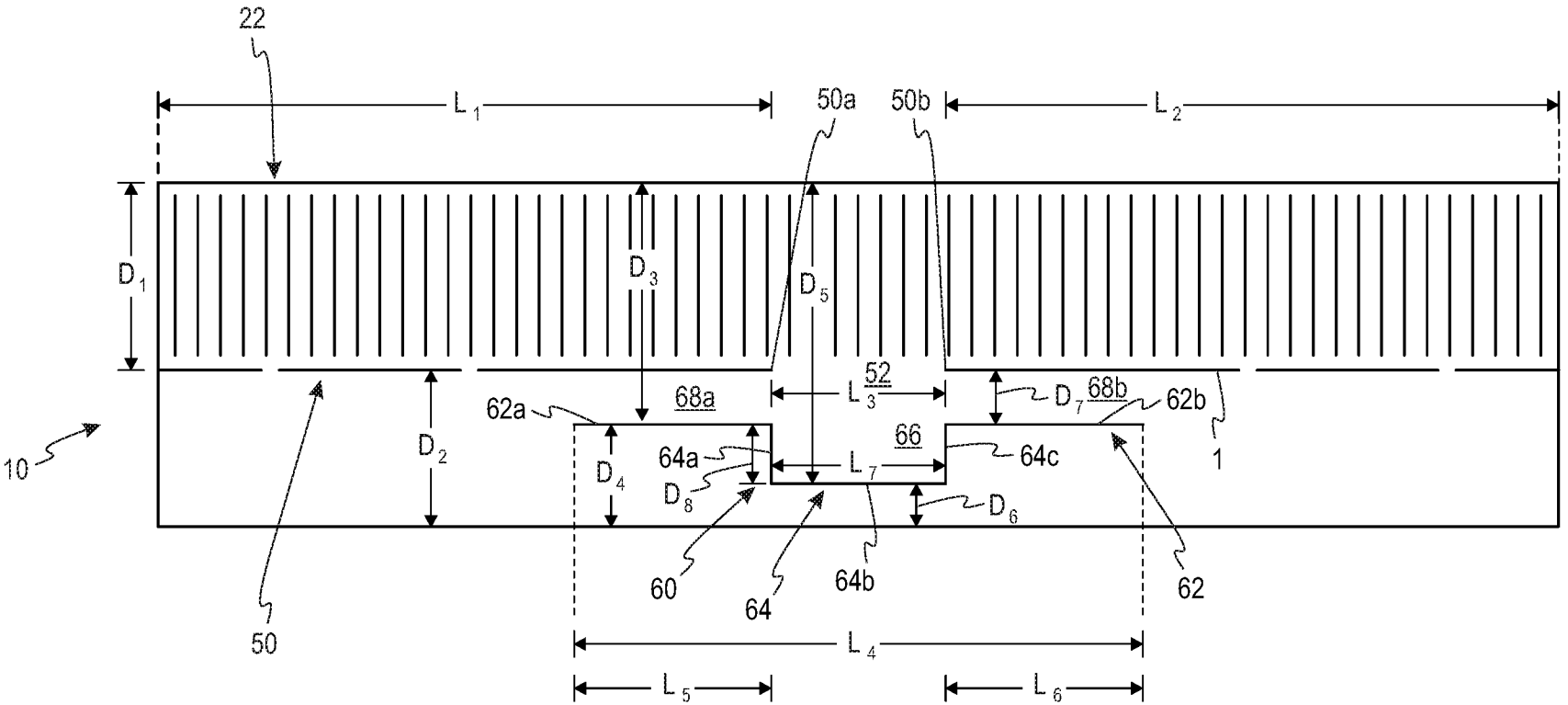
FIG. 4 is a flattened schematic side view of the circumference of the closure of FIG. 1A depicting the first and second frangible connections in an unbroken position.

FIG. 4 depicts the entire circumference of the closure 10 in a flatten side view in an unopened position. The first frangible connection 50 extends around the circumference of the twist and flip closure 10. The first frangible connection generally extends from about 280 to about 330 degrees around the circumference of the twist and flip closure 10. More specifically, the first frangible connection extends from about 300 to about 325 degrees or, more specifically, from about 310 to about 320 degrees around the circumference of the twist and flip closure 10. The distance of the first frangible connection is shown in FIG. 4 as length L1 plus length L2.

The first frangible connection 50 has a first end 50*a* and a second end 50*b*. The first and second ends 50*a*, 50*b* are spaced apart. This is shown in FIG. 4 as a gap 52. The gap 52 is generally from about 30 to about 80 degrees and, more specifically, from about 40 to about 60 degrees around the circumference of the closure. This is shown as length L3 in FIG. 4. The first frangible connection 50 of FIG. 4 has a distance D1 (distance to the top wall portion) of from about 7 about 14 mm and, more specifically, from about 8 to about 11 mm. The first frangible connection 50 of FIG. 4 has a distance D2 (distance to the end opposite of the top wall portion) of from about 5 to about 12 mm and, more specifically, from about 6 to about 9 mm.

The second frangible connection 60 has a first section 62 and a second section 64. As shown in FIG. 4, the second frangible connection 60 extends generally from about 120 to about 180 degrees around the circumference of the closure 10. More specifically, the second frangible connection extends from about 130 to about 170 degrees around the circumference of the closure 10. The distance of the second frangible connection 60 is shown in FIG. 4 as length L4.

As shown in FIG. 4, the first section 62 has a plurality of segments 62*a*, 62*b*. The segments 62*a*, 62*b* of the second frangible connection 60 are located a distance D3 (distance to the top wall portion 22) of from about 8 to about 16 mm and, more specifically, from about 9 to about 12 mm. The segments 62*a*, 62*b* of the second frangible connection 60 are located a distance D4 (distance to the end opposite of the top wall portion) of from about 3 to about 8 mm and, more specifically, from about 4 to about 7 mm.

The segment 62*a* of the second frangible connection 60 has a length L5 of from about 30 to about 90 degrees and, more specifically, from about 40 to about 70 degrees. The segment 64*b* of the second frangible connection 60 has a length L6 of from about 30 to about 90 degrees and, more specifically, from about 40 to about 70 degrees.

As shown in FIG. 4, the second section 64 of the second frangible connection 60 is located a distance D5 (distance to the top wall portion) of from about 11 to about 17 mm and, more specifically, from about 12 to about 15 mm. The distance D5 is greater than the distance D3. The second section 64 of the second frangible connection 60 is located a distance D6 (distance to the end opposite of the top wall portion) of from about 1 to about 6 mm and, more specifically, from about 2 to about 4 mm. The second section 64 of the second frangible connection 60 has a distance D8 of from about 1 to about 4 mm and, more specifically, from about 2 to about 3 mm. The second section 64 of the second frangible connection has a length L7 of from about 30 to about 80 degrees and, more specifically, from about 40 to 60 degrees.

The second frangible connection 60 has a configuration that includes the first section 62 and the second section 64. The first section 62 has two segments 62*a*, 62*b* and the second section 64 has three segments 64*a-c*. The first section 62 and the second section 64 are connected as shown in FIG. 4. The two segments 62*a*, 62*b* are generally horizontal. The segments are 64*a*, 64*c* are generally vertical, while the segment 64*b* is generally horizontal. The segments 64*a-c* are connected with each other and form an area 66. The segments 64*a-c* form a general U-shape.

It is contemplated that the second section of the second frangible connection may be of shapes other than U-shaped. For example, the second section of the second frangible connection may be an elongated oval section or a W-shape.

The second frangible connection 60 is spaced from the first frangible connection 50. This is shown in FIG. 4 as distance D7. At least a portion of the second frangible connection is located further from the top wall portion than a portion of the first frangible connection. In FIG. 4, the entire second frangible connection 60 is located further from the top wall portion 22 than the first frangible connection 50. It is contemplated that the second frangible connection may be formed differently than depicted in FIG. 4.

The first and second frangible connections 50, 60 may be formed by molded-in-bridges in one embodiment. In this embodiment, the molded-in-bridges are formed using a feature in the mold. The first and second frangible connections are in the form of scoring or scored lines, notches, leaders, nicks or other lines of weaknesses.

In another method, the first and second frangible connections are formed by a slitting technology that is independent from the formation of the remainder of the twist and flip closure. The first and second frangible connections are formed using scoring or scored lines, notches, leaders, nicks or other lines of weaknesses.

The area 66 is formed between the first section 62 and the second section 64 of the second frangible connection 60 as shown in FIG. 4. The area 66 is adapted to form a tab 70 after the closure has been fully twisted (i.e., fully unthreaded) as shown, for example, in FIG. 1C. The tab 70 is located between the first and second ends 50*a*, 50*b* as shown in FIG. 4. The area that forms a tab is generally aligned with a gap formed between first and second ends of a first frangible connection. In FIG. 4, the area 66 is substantially aligned with the gap 52 formed between the first and second ends 50*a*, 50*b* of the first frangible connection 50. It is contemplated that the area to form the tab should be located in such a manner that the tab acts as a hinge when the closure is flipped and then acts as a lock when the closure has been flipped.

As will be discussed below in more detail, areas 68*a*, 68*b* are formed between the first frangible connection 50 and the second frangible connection 60 as shown in FIG. 4. The areas 68*a*, 68*b* form hinged arms 72*a*, 72*b* after the first and second frangible connections are broken. The hinged arms 72*a*, 72*b* (see, e.g., FIG. 1C) assist in: (1) keeping the first closure portion 12 and the second closure portion 14 together; (2) flipping the first closure portion 12 with respect to the second closure portion 14 in conjunction with the tab 70; and (3) locking the first closure portion 12 with the tab 70. The hinged arms 72*a*, 72*b* are sized and shaped to be twisted and stretched.

The stretching of the hinged arms 72*a*, 72*b* is shown, for example, in FIG. 1C by a gap 76 created from the movement of the tab 70. The gap 76 of FIG. 1C is larger than a gap 78 shown in FIG. 1B. The growth of this gap assists in providing a spatial relationship for providing clearance to flip the first closure portion 12 with respect to the second closure portion 14. The spatial relationship for clearance of the first closure portion 12 with respect to the second closure portion 14 is also dependent on other features such as the length of the annular skirt portion 34, the positioning and type of internal and external threads, and the size and shape of the tab 70.

Referring specifically to FIG. 1A, the polymeric tamper-evident band 34 of the closure 10 is located at the bottom thereof (i.e., an end opposite of the polymeric top wall portion 22). The tamper-evident band 34 depends from and is at least partially detachably connected to the annular skirt portion 32 by the first frangible connection 50. As viewed in FIG. 1A, the polymeric tamper-evident band 34 is a lower tamper-evident feature. The tamper-evident band 34 works in conjunction with the container to indicate to a user that the contents of the container may have been accessed. More specifically, the tamper-evident band 34 is designed to partially separate from the annular skirt portion 32 when a user opens the package by twisting the first closure portion 12 with respect to the second closure portion 14. This twisting unthreads the closure 10 with respect to the container 108.

Figure 5:
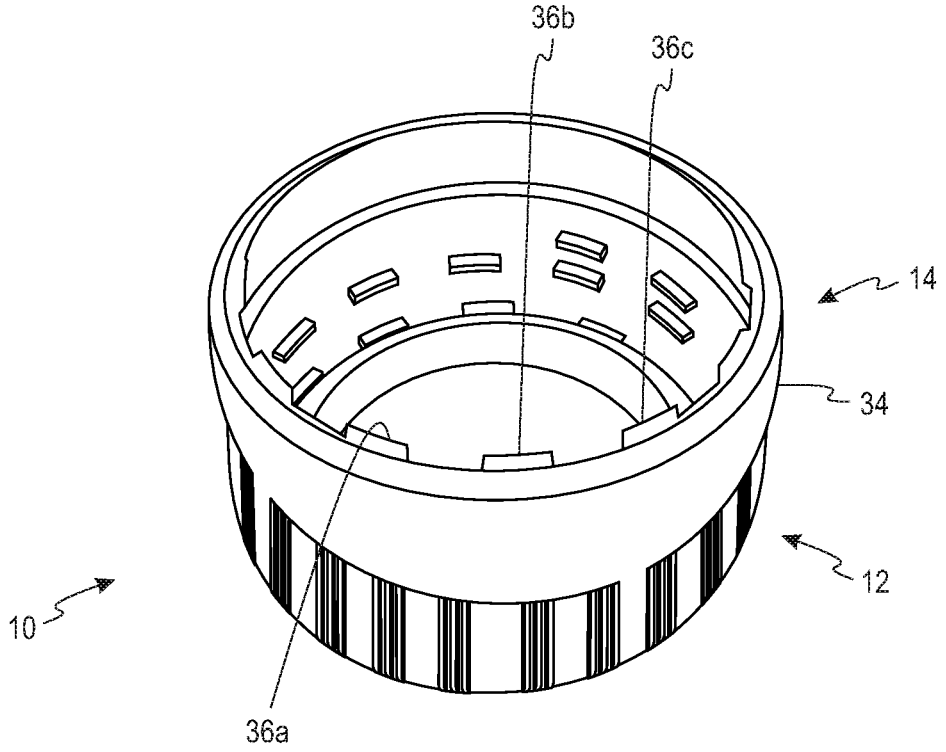
FIG. 5 is a bottom perspective view from the back of the closure depicted in FIG. 1A.

In one embodiment, the tamper-evident band includes at least one band extension. For example, the closure 10 is shown in FIG. 5 depicts the tamper-evident band 34 including a plurality of band extensions 36*a-c*. As will be discussed in more detail below, the plurality of band extensions 36*a-c* assists in positioning the first closure portion or lid 12 in a locked position after the flipping process.

One non-limiting example of a twist and flip closure and a container forming a package is shown and previously discussed in conjunction with FIGS. 1A-1D. FIGS. 1A-1D depict the closure 10 and the container 108 forming the package 100. A portion of the container 108 is shown in FIGS. 1A-D and includes a neck portion 102 (FIG. 1D) that defines an opening. Referring to FIG. 1D, the neck portion 102 of the container 108 includes an external thread formation 104, an A-collar 106 (FIG. 1C) and a continuous outer ring 110.

The external thread formation 104 includes a first finish lead 142 and a second finish lead 144. The external thread formation 104 (finish leads 142, 144) engages with the corresponding internal thread formation 40 (closure leads 42, 44) (FIG. 3) to seal the package 100. The first finish lead 142, 144 may extend in a helical fashion such as shown in FIG. 1D. Each of the first and second finish leads 142, 144 is discontinuous.

In another embodiment, the first positions of the first and second finish leads are located roughly 180 degrees apart from each other and, thus, begin on opposing sides of the neck portion of the container. When opening the container, a first closure lead is desirably in contact with the first finish lead and the second closure lead is desirably in contact with the second finish lead. It is contemplated that the external thread formation of the container may have discontinuous leads.

It is contemplated that the external thread formation of the container may be different than depicted in FIG. 1D. Another non-limiting example is depicted in FIG. 2C with the container 208 having a continuous helical external thread formation 204.

The A-collar 106 (FIG. 1C) prevents or inhibits a tamper-evident band 34 from being removed after the first and second frangible connections 50, 60 are broken. The continuous outer ring 110 assists in positioning the tamper-evident band 34.

The closures of the present invention may include an oxygen-scavenger material. This oxygen-scavenger material may be distributed within the closure or may be a separate layer. The oxygen-scavenger material may be any material that assists in removing oxygen within the container, while having little or no effect on the contents within the container.

Alternatively, or in addition to, the closures may include an oxygen-barrier material. The oxygen-barrier material may be added as a separate layer or may be integrated within the closure itself. The oxygen-barrier materials assist in preventing or inhibiting oxygen from entering the container through the closure. These materials may include, but are not limited to, ethylene vinyl alcohol (EVOH). It is contemplated that other oxygen-barrier materials may be used in the closure.

Additionally, it is contemplated that other features may be included in the closure described above. For example, U.S. Publication No. 2018/009979, U.S. Publication No. 2017/0349336, U.S. Pat. Nos. 9,126,726, 9,085,385, 8,763,830, 8,485,374, U.S. Publication No. 2009/0045158 and U.S. Pat. No. 6,123,212 all include features that could be incorporated in the closures of the present invention. All of these references are hereby incorporated by reference in their entireties.

The top wall portion 22 and the annular skirt portion 32 are made of polymeric material. The top wall portion 22 and the annular skirt portion 32 are typically made of an olefin (e.g., polyethylene (PE), polypropylene (PP)), polyethylene terephthalate (PET) or blends thereof. One example of a polyethylene that may be used in high density polyethylene (HDPE). It is contemplated that the top wall portion and the annular skirt portion may be made of other polymeric materials. The tamper-evident band 34 is typically made of the same materials as the top wall portion 22 and the annular skirt portion 32.

The closures are typically formed by processes such as injection or compression molding, extrusion or the combination thereof.

The container 108 is typically made of polymeric material. One non-limiting example of a material to be used in forming a polymeric container is polyethylene terephthalate (PET), polypropylene (PP) or blends using the same. It is contemplated that the container may be formed of other polymeric or copolymer materials. It is also contemplated that the container may be formed of glass. The container 108 typically has an encapsulated oxygen-barrier layer or oxygen barrier material incorporated therein.

In one method to open the container 108 and gain access to the product therein, the first closure portion 12 is initially twisted and then flipped with respect to the second closure portion 14. Referring initially to FIGS. 1A-1D and FIGS. 2A-2C, methods of opening the twist and flip closure are shown. FIGS. 1A and 2A depict the first and second frangible connections 50, 60 in an unopened position after the closure 10 has been applied onto the container 108. A user than twists the closure 10 generally along the first and second frangible connections 50, 60, which begins breaking the first and second frangible connections 50, 60. The user will continue twisting the closure until there are no more thread engagements between the closure and the container and the first and second frangible connections have been fully broken. FIGS. 1C and 2B depict the closure 10 and respective containers 108, 208 after the twisting has been completed (i.e., unthreaded completely).

After the twisting has been completed, then a user flips the first closure portion 12 with respect to the second closure portion 14. The first closure portion 12 and the second closure portion 14 are flipped using the tab 70, which acts as a hinge after the first and second frangible connections 50, 60 have been fully broken. The tab 70 is shown in FIGS. 1C, 1D and 2C. The hinged arms 72*a*, 72*b* during the flipping process are twisted and stretched as the tab 70 is moved.

Figure 6A:
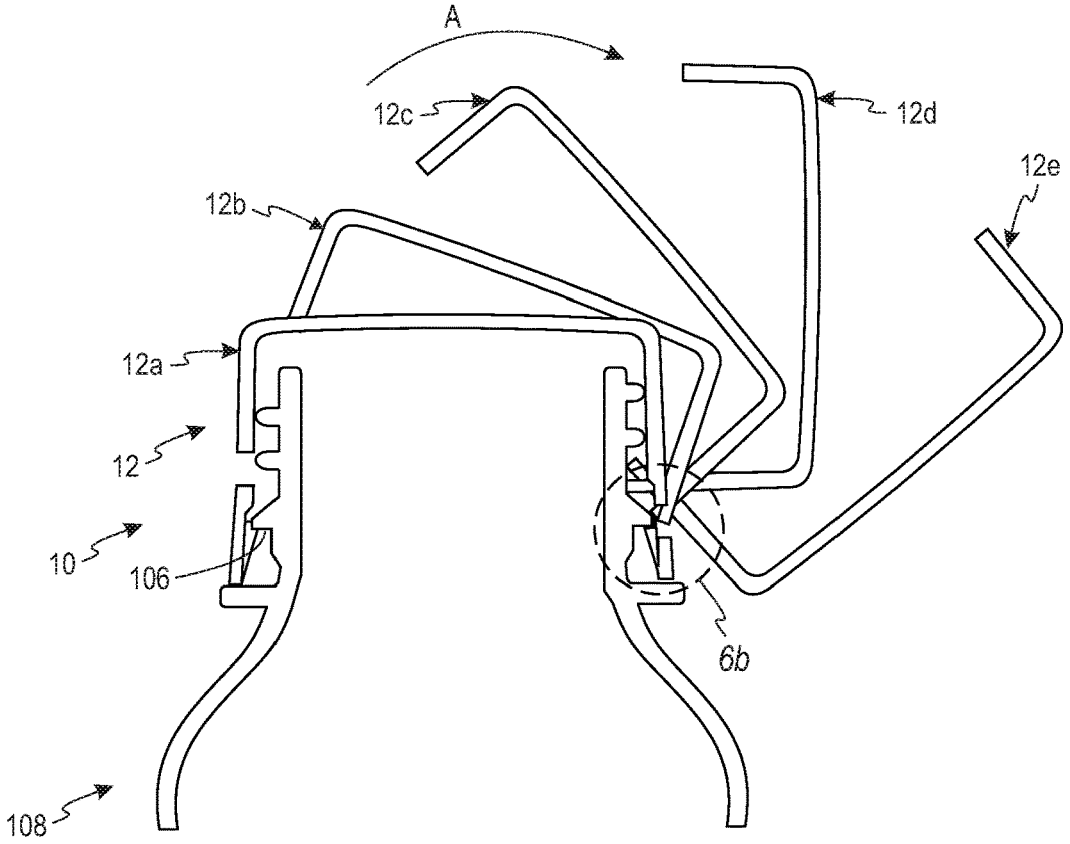
FIG. 6A is a cross-sectional view (without the cross-hatching) showing the lid in various positions or stages during flipping according to one embodiment.
Figure 6B:
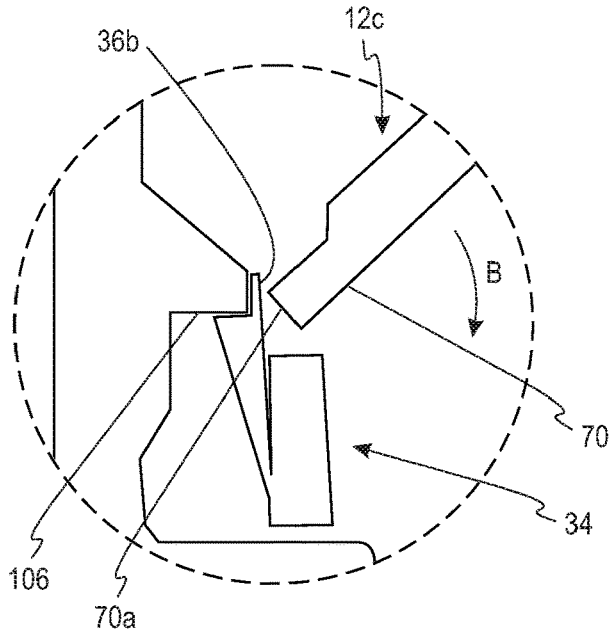
FIG. 6B is an enlarged view of a generally circular area 6*b* of FIG. 6A showing one position of the lid during the flipping process.

The movement of the first closure portion or lid during the flipping process is best shown in FIGS. 6A and 6B. FIG. 6A shows a side cross-sectional view (without cross-hatching) of the closure 10 and the container 108 in various positions or stages during the flipping process. The initial position of the first closure portion or lid 12 is designated as 12*a* in FIG. 6A. After a user begins flipping the lid 12 back in the general direction of arrow A, the lid moves to a second position (designated as 12*b*), a third position (designated as 12*c*), to a fourth position (designated as 12*d*) and to a fifth position (designated as 12*e*).

The first closure portion or lid 12 is adapted to flip or rotate at least about 115 degrees from a closed position to an open position generally along the arrow A of FIG. 6. It is desirable for the first closure portion or lid 12 to flip or rotate at least about 125 degrees or even more desirably at least 135 degrees from a closed position to an open position until being locked.

FIG. 6B shows an enlarged view of area 6*b* taken from FIG. 6A. FIG. 6B depicts a portion of the first closure portion or lid 12 in the third position 12*c* and shows the functionality of the band extension 36*b* with respect to the A-collar 106 of the container 108. The tamper-evident feature 34 engages the A-collar 106 to prevent or inhibit the tamper-evident band 34 from being removed after the first and second frangible connections 50, 60 are broken.

As shown in FIG. 6B, the band extension 36*b* prevents or inhibits the tab 70 from slipping under the A-collar 106 of the container 108 during movement from the third position (designated as 12*c*) to the fourth position (designated as 12*d*) of FIG. 6A. More specifically, during the flipping of the first closure portion 12 during the product opening, the band extension 36*b* provides a transition lip over the A-collar 106 of the container 108 preventing or inhibiting the tab 70 from slipping under the A-collar 106 and becoming stuck, which prevents or inhibits full rotation of the first closure portion 12. The forces in rotation along arrow B (see FIG. 6B) allows the tab 70 to slip over the A-collar 106 across the band extension 36*b*.

As the tab 70 is rotated during the movement of the first closure portion 12, the hinged arms 72*a*, 72*b* are twisted and stretched. The tab 70 contacts an outer surface of the neck portion 102. In one method, the tab 70 is generally perpendicular to the outer surface of the neck portion 102, which causes the hinged arms 72*a*, 72*b* to be greatly stretched. The force required to move the tab to this position is greater than during initial movement of the tab during the flipping process. As the first closure portion 12 is continued to be flipped, an edge 70*a* of the tab 70 continues moving upwardly (toward the top of the neck portion 102) to a position shown in, for example, FIG. 1D. The tab 70 is sized, and formed to be resilient, but capable of flexing during this movement. At this point, the hinged arms 72*a*, 72*b* are not as stretched and are in stable positions.

After the first closure portion 12 has been flipped, the tab 70 in conjunction with the hinged arms 72*a*, 72*b* lock the first closure portion 12 with respect to the second closure portion 14 as shown in FIGS. 1D and 2C. The hinged arms 72*a*, 72*b* are stable and maintain the tab in a locked position. To overcome this stable position and return the tab 70 back to the generally perpendicular position with respect to the neck portion 102, the first closure portion 12 would need some force applied to cause the hinged arms 72, 72*b* to be returned to this greatly stretched position. The closure 10 is adapted to be returned to its initial position by flipping back the first closure portion 12 and then threaded the closure 10 onto the container 108.

The polymeric closures of the present invention are desirable in both low-temperature and high-temperature applications. The polymeric closures may be used in low-temperature applications such as an ambient or a cold fill. These applications include water, sports drinks, aseptic applications such as dairy products, and pressurized products such as carbonated soft drinks. It is contemplated that other low-temperature applications may be used with the polymeric closures formed by the processes of the present invention.

The polymeric closures of the present invention may be exposed to high-temperature applications such as hot-fill, pasteurization, and retort applications. A hot fill application is generally performed at temperatures around 185° F., while a hot-fill with pasteurization is generally performed at temperatures around 205° F. Retort applications are typically done at temperatures greater than 250° F. It is contemplated that the polymeric closures of the present invention can be used in other high-temperature applications.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above described embodiment, method, and examples, but by all embodiments and methods within the scope and spirit of the invention.

What is claimed is:

1. A package comprising:

a container having a neck portion defining an opening, the container having an external thread formation on the neck portion; and a closure being configured for fitment to the neck portion of the container for closing the opening, the closure comprising:

a first closure portion including:

a polymeric top wall portion, and a polymeric annular skirt portion depending from the polymeric top wall portion, the annular skirt portion including an internal thread formation for mating engagement with an external thread formation of a container;

a second closure portion including:

a first frangible connection extending around the circumference of the closure from about 280 degrees to about 330 degrees, the first frangible connection having a first end and a second end defining a gap therebetween, the gap extending from about 30 degrees to 80 degrees around the circumference of the closure, the first frangible connection spaced from about 7 mm to about 14 mm from the top wall portion and spaced from about 5 mm to 12 mm from an end opposite the top wall portion;

a second frangible connection extending around the circumference of the closure from about 120 degrees to about 180 degrees, the second frangible connection spaced from about 8 mm to about 16 mm from the top wall portion, the second frangible connection spaced further from the top wall portion than the first frangible connection;

wherein a portion of the second frangible connection acts as a hinge when the first closure portion is flipped and then acts as a lock when the first closure portion has been flipped;

wherein areas formed between the first frangible connection and the second frangible connection form hinged arms after the first and second frangible connections are broken.

2. The package of claim 1, wherein the hinged arms keep the first closure portion and the second closure portion together.

3. The package of claim 2, wherein the hinged arms assist in flipping the first closure portion with respect to the second closure portion.

4. The package of claim 2, wherein the hinged arms are sized and shaped to be twisted and stretched.

5. The package of claim 1, wherein the second frangible connection further comprises a first additional frangible portion and a second additional frangible portion, the area between the first and second additional frangible portions defining a tab.

6. The package of claim 1, wherein the first frangible connection is spaced from about 8 mm to about 11 mm from the top wall portion.

7. The package of claim 1, wherein the first frangible connection is spaced from about 6 mm to about 9 mm from an end opposite the top wall portion.

8. The package of claim 1, wherein the second frangible connection is spaced from about 9 mm to about 12 mm from the top wall portion.

9. The package of claim 1, wherein the second frangible connection extends around the circumference of the closure from about 130 to about 170 degrees.

10. The package of claim 1, wherein the first frangible connection extends around the circumference of the closure from about 300 degrees to about 325 degrees.

11. A package comprising:

a container having a neck portion defining an opening, the container having an external thread formation on the neck portion; and a closure being configured for fitment to the neck portion of the container for closing the opening, the closure comprising:

a first closure portion including:

a polymeric top wall portion, and a polymeric annular skirt portion depending from the polymeric top wall portion, the annular skirt portion including an internal thread formation for mating engagement with an external thread formation of a container;

a second closure portion including:

a first frangible connection extending around the circumference of the closure from about 280 degrees to about 330 degrees, the first frangible connection having a first end and a second end defining a gap therebetween, the gap extending from about 30 degrees to 80 degrees around the circumference of the closure, the first frangible connection spaced from about 7 mm to about 14 mm from the top wall portion and spaced from about 5 mm to 12 mm from an end opposite the top wall portion;

a second frangible connection extending around the circumference of the closure from about 120 degrees to about 180 degrees, the second frangible connection spaced from about 8 mm to about 16 mm from the top wall portion, the second frangible connection spaced further from the top wall portion than the first frangible connection;

wherein areas formed between the first frangible connection and the second frangible connection form hinged arms after the first and second frangible connections are broken, wherein the closure is configured to lock after being moved to an open position.

12. The package of claim 11, wherein the hinged arms keep the first closure portion and the second closure portion together.

13. The package of claim 12, wherein the hinged arms are sized and shaped to be twisted and stretched.

14. The package of claim 11, wherein the second frangible connection further comprises a first additional frangible portion and a second additional frangible portion, the area between the first and second additional frangible portions defining a tab.

15. The package of claim 11, wherein the first frangible connection is spaced from about 8 mm to about 11 mm from the top wall portion.

16. The package of claim 11, wherein the first frangible connection is spaced from about 6 mm to about 9 mm from an end opposite the top wall portion.

17. The package of claim 11, wherein the second frangible connection is spaced from about 9 mm to about 12 mm from the top wall portion.

18. The package of claim 11, wherein the second frangible connection extends around the circumference of the closure from about 130 to about 170 degrees.

19. The package of claim 11, wherein the first frangible connection extends around the circumference of the closure from about 300 degrees to about 325 degrees.

* * * * *